US009187292B2

(12) United States Patent
Brügger et al.

(10) Patent No.: US 9,187,292 B2
(45) Date of Patent: Nov. 17, 2015

(54) SUPPORT FRAME WITH DAMPING ELEMENTS FOR MOUNTING AN ELEVATOR CAGE

(75) Inventors: Beat Brügger, Lucerne (CH); Christoph Schuler, Cham (CH); Lukas Zeder, Huddinge (SE); Thomas Wuest, Hochdorf (CH); Urs Schaffhauser, Root (CH); René Strebel, Sarmenstorf (CH)

(73) Assignee: Inventio AG, Hergiswil (CH)

( * ) Notice: Subject to any disclaimer, the term of this patent is extended or adjusted under 35 U.S.C. 154(b) by 885 days.

(21) Appl. No.: 13/223,668

(22) Filed: Sep. 1, 2011

(65) Prior Publication Data

US 2012/0048658 A1 Mar. 1, 2012

(30) Foreign Application Priority Data

Sep. 1, 2010 (EP) ..... 10174875

(51) Int. Cl.
*B66B 11/02* (2006.01)

(52) U.S. Cl.
CPC ..... *B66B 11/0206* (2013.01); *B66B 11/0273* (2013.01)

(58) Field of Classification Search
CPC ..... B66B 11/0273; B66B 11/0206
USPC ..... 187/401, 249, 291
IPC ..... B66B 11/02
See application file for complete search history.

(56) References Cited

U.S. PATENT DOCUMENTS

| | | | | |
|---|---|---|---|---|
| 2,246,732 | A * | 6/1941 | Hymans | 187/401 |
| 5,325,937 | A | 7/1994 | Suchodolski et al. | |
| 5,490,577 | A * | 2/1996 | Yoo | 187/252 |
| 5,613,667 | A * | 3/1997 | Ho | 267/141.1 |
| 6,161,652 | A * | 12/2000 | Kostka et al. | 187/291 |
| 6,431,325 | B1 * | 8/2002 | Bledsoe et al. | 187/292 |
| 7,261,185 | B2 * | 8/2007 | Strebel et al. | 187/249 |

FOREIGN PATENT DOCUMENTS

| | | | | |
|---|---|---|---|---|
| GB | 2306440 | A * | 5/1997 | B66B 11/02 |
| JP | 11171437 | A * | 6/1999 | B66B 11/02 |
| WO | WO 2009025042 | A1 * | 2/2009 | B66B 11/02 |

OTHER PUBLICATIONS

AIPN, Machine Translation, JP 11171437A, Nov. 9, 2014, pp. 1-3.*

* cited by examiner

*Primary Examiner* — Emmanuel M Marcelo
*Assistant Examiner* — Stefan Kruer
(74) *Attorney, Agent, or Firm* — Fraser Clemens Martin & Miller LLC; William J. Clemens

(57) ABSTRACT

A support frame has at one or more lower cage corners a respective support, at which at least one damping element is arranged. The support has a U-shaped cross-section and can be inserted into a beam with C-shaped cross-section. The elevator cage is mounted on the damping elements, which can keep oscillations and vibrations away from the elevator cage. Near the inserted support, a device can be provided for raising the elevator cage if the support or at least one damping element has to be replaced.

6 Claims, 4 Drawing Sheets

SUPPORT FRAME WITH DAMPING ELEMENTS FOR MOUNTING AN ELEVATOR CAGE

CROSS-REFERENCE TO RELATED APPLICATION

This application claims priority to European Patent Application No. 10174875.4, filed Sep. 1, 2010, which is incorporated herein by reference.

FIELD

The disclosure relates to a support frame with damping elements for mounting an elevator cage.

BACKGROUND

A support frame for supporting an elevator cage has become known from the patent specification U.S. Pat. No. 2,246,732. The support frame substantially consists of an upper yoke and a lower yoke which are connected by means of a vertical beam. A base frame resting on the lower yoke is provided with damping elements on which an elevator cage rests. The support frame is suspended at support cables which are guided over a drive pulley and connected with a counterweight. The elevator cage and counterweight are moved back and forth by an elevator drive in opposite directions in an elevator shaft.

SUMMARY

In at least some embodiments of the disclosed technologies, the damping elements mounting the elevator cage can be exchanged in simple manner in situ. Provided at each corner of the elevator cage is a support at which at least one damping element can be mounted. The support can be insertable into a base frame and connectible with the elevator cage. The support can be exchangeable without having to remove the elevator cage. The damping elements can also age and fatigue depending on the incidence of traffic and environmental influences. The support with the damping elements can also be retrofitted in simple manner to existing elevator installations, for example, in the case of base frames constructed from profile members.

BRIEF DESCRIPTION OF THE DRAWINGS

The present disclosure is explained in more detail by way of the accompanying figures, in which.

DETAILED DESCRIPTION

Figure 1:
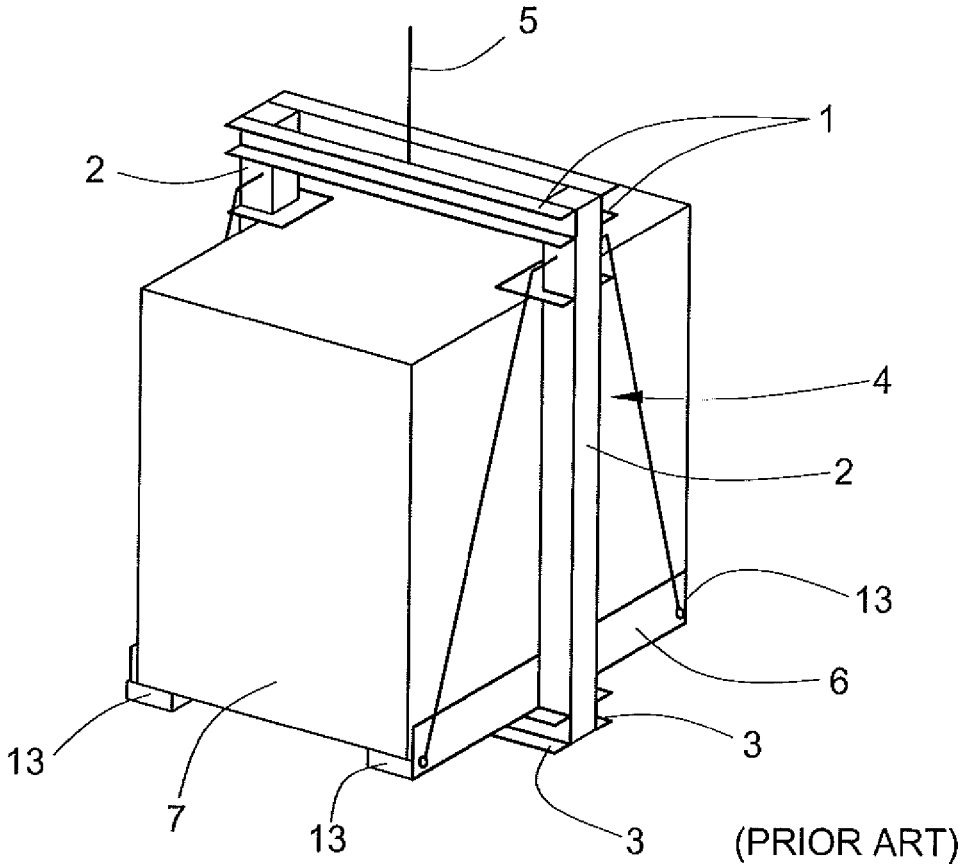
FIG. 1 shows an exemplary embodiment of an elevator cage carried by a support frame and mounted on damping elements of the prior art.

FIG. 1 shows an exemplifying embodiment of an elevator cage supported by a support frame 4 and mounted on damping elements 13 of the prior art. The support frame 4 comprises an upper yoke 1 and a lower yoke 3. The yokes 1, 3 are connected by means of vertical, first beams 2. A base frame 6 resting on the lower yoke 3 is provided at each cage corner with at least one damping element 13. The elevator cage 7 is mounted on the damping elements 13, which can keep oscillations and vibrations substantially away from the elevator cage 7. The support frame 4 is suspended at support means 5, which comprises, for example, steel cables, synthetic fiber cables, flat belts, wedge-ribbed belts, V-belts, etc., wherein the support means 5 is guided by way of a drive pulley (not illustrated) and connected with a counterweight (not illustrated). Elevator cage and counterweight are moved back and forth by an elevator drive (not illustrated) in opposite directions in an elevator shaft (not illustrated).

Figure 2:
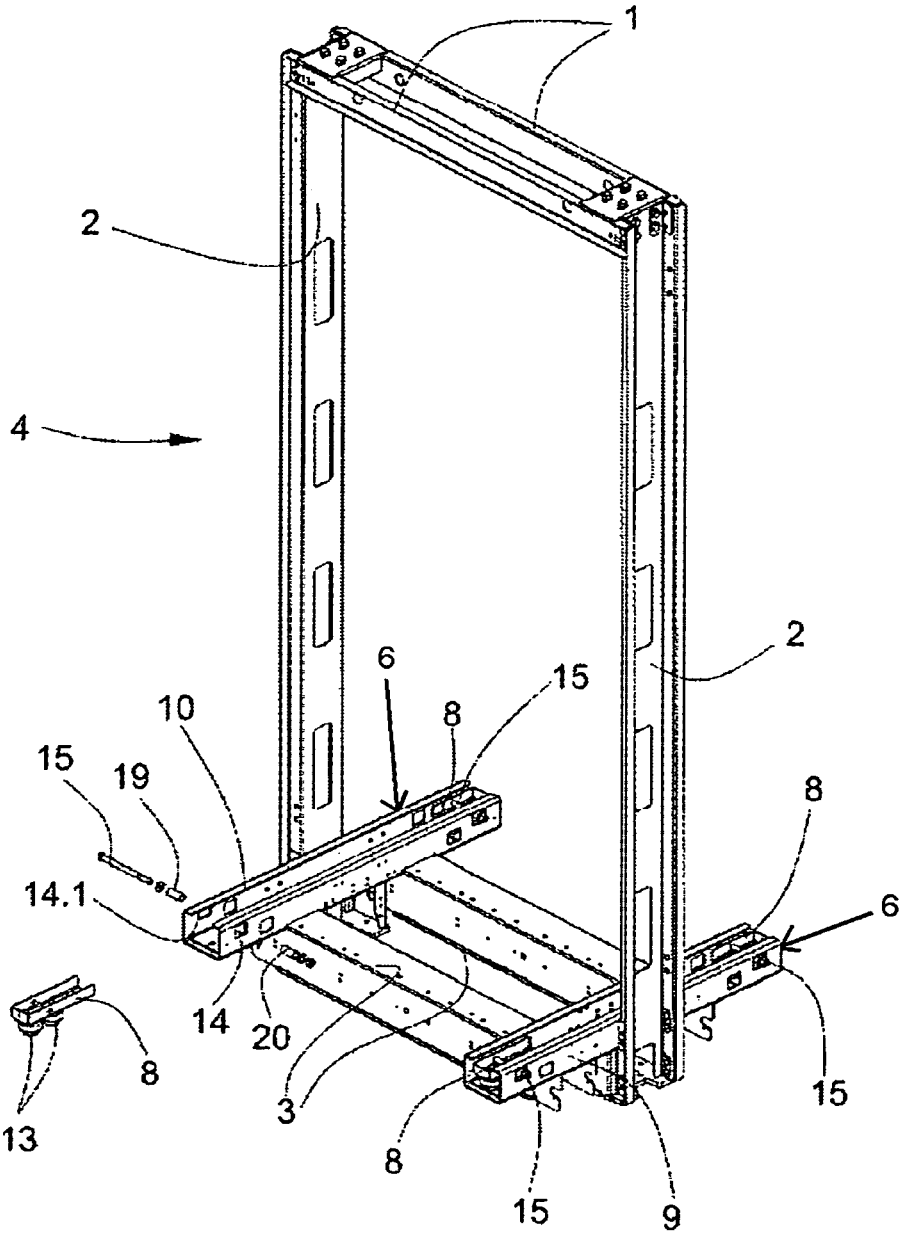
FIG. 2 shows an exemplary embodiment of the support frame with a support provided at each cage corner.

FIG. 2 shows the support frame 4 with an exemplifying embodiment of a respective support 8, which is provided at each lower cage corner and at which at least one damping element 13 is arranged. The base frame 6 is, for example, formed from at least one second beam 9 resting on the lower yoke 3 and third beam 10 resting on the lower yoke 3. The support 8 has, in the illustrated exemplifying embodiment, a U-shaped cross-section and can be pushed into the second or third beam 9, 10 with C-shaped cross-section. A support 8 with at least one damping element 13 can be inserted at each end of the second or third beam 9, 10.

The support 8 and the beam 9, 10 can also have other cross-sections departing from those mentioned above. A precondition is that the support 8 can be inserted into the beam 9, 10. For example, the support 8 and the beam 9, 10 can be tubular, wherein the support tube can be received by the carrying tube.

Figure 3:
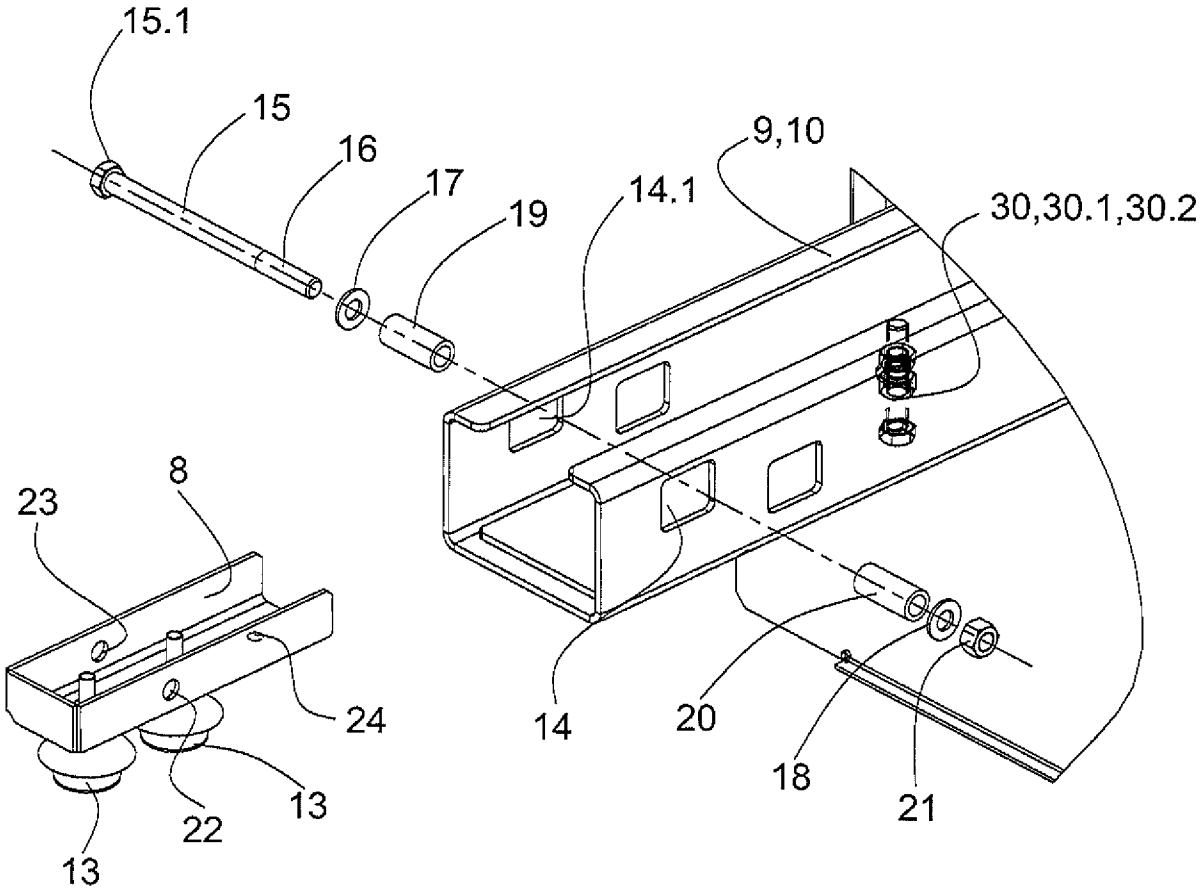
FIG. 3 shows exemplary details of the support frame and the support.
Figure 4:
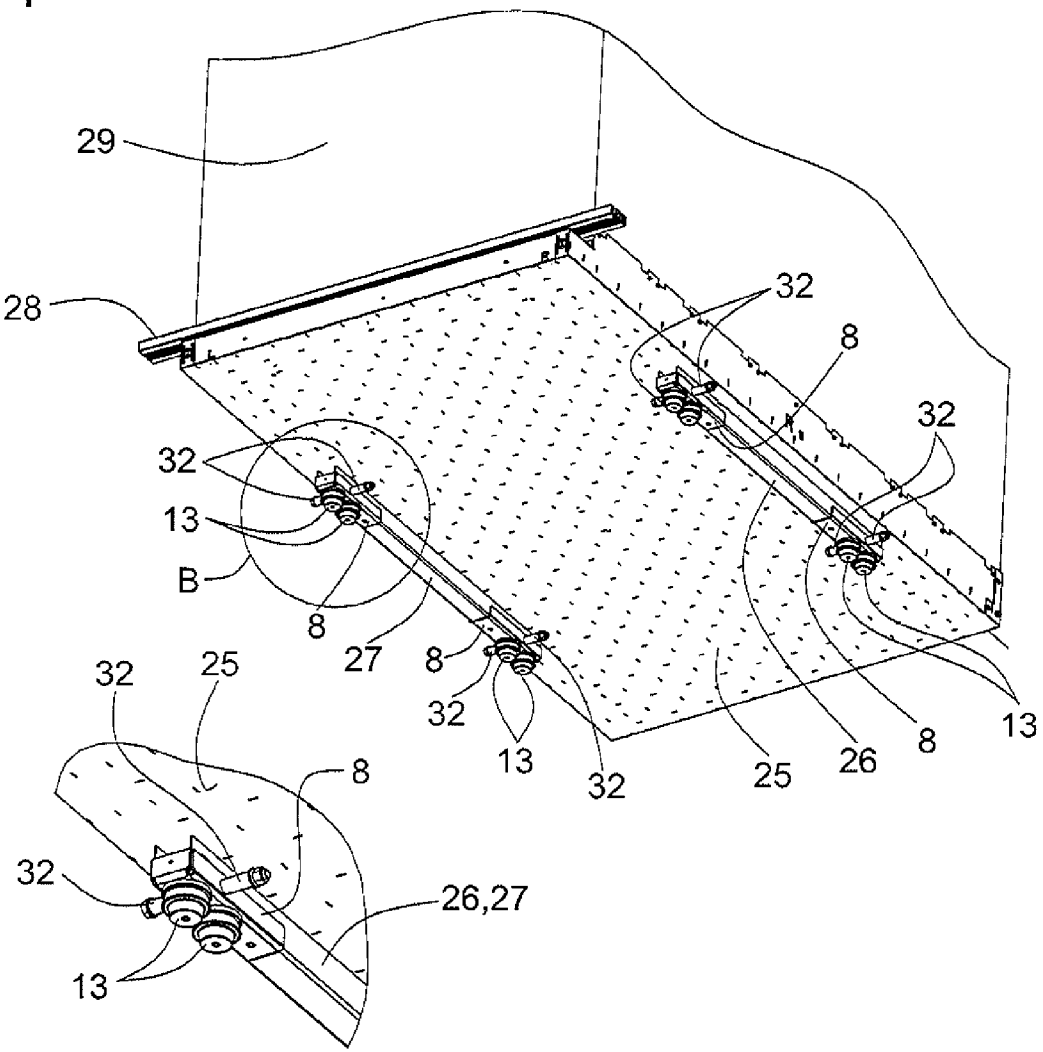
FIG. 4 shows exemplary embodiments of the supports connected with the elevator cage.

FIG. 3 shows, by way of example, details of the second and third beam 9, 10 and the support 8, wherein the support 8 for the sake of better clarity is shown not inserted into the beam 9, 10. The second or third beam 9, 10 has at each end a first and second recess 14, 14.1, through which a first bolt 15 extends by a first thread 16. Belonging to the first bolt 15 with, for example, a hexagonal head 15.1 are also first and second U-washers 17, 18, first and second sleeves 19, 20 and a first nut 21. When the support 8 is inserted the first bolt 15 penetrates first and second bores 22, 23 of the support 8. The first bolt 15 connects the support 8 with a floor structure of the elevator cage. Details are shown in FIG. 4. The first bolt 15 penetrates the first recess 14, but does not contact this in the normal case. In the case of impact of the elevator cage 7 on the shaft, pit buffer or buffers, the first bolt acts as travel limiter for the elevator cage 7 relative to the second and third beams 9, 10. The first bolt 15, in the case of buffer travel of the elevator cage 7, stands at the first and second recess 14, 14.1, wherein the recesses 14, 14.1 serve as abutment for the first bolt 15.

As is shown in FIG. 3, the support 8 can be equipped with two damping elements 13. The support 8 can be equipped with a further damping element 13 in a third bore 24. Only a single damping element 13 per support 8 is also possible. After insertion of the supports 8 into the second and third beams 9, 10 and after connecting the supports 8 with the elevator cage 8 according to FIG. 4, the damping elements 13 lie on the second or third beam 9, 10. Each damping element 13 is connected (for example, screw-connected) at one end with the support 8 and at the other end, after insertion of the support 8 into the beam 9, 10, with the beam 9, 10. The damping element 13 thus cannot shift on the beam 9, 10.

FIG. 4 shows exemplary embodiments of the supports 8 connected with the elevator cage 7. At least fourth and fifth beams 26, 27, which are arranged at a cage floor 25, are connected with the supports 8. The cage floor 25 carries a cage threshold 28 and a cage structure 29. As shown in the detail B, the first bolt 15 connects the support 8 with the end of the respective fourth or fifth beam 26, 27. The first sleeve 19 is arranged outside the support 8 on the hexagonal head side and the second sleeve 20 outside the support 8 on the nut side. The projection 32, which is respectively formed by the sleeves 19, 20, respectively penetrates the first or second recess 14, 14.1 and can provide the above-mentioned travel limitation in the case of a buffer travel of the elevator cage 7.

Instead of the connecting elements consisting of the bolt 15 and sleeves 19, 20 it is also possible to provide a differently formed connecting element. A precondition can be that the connecting element detachably connects the support 8 with the beam 26, 27 of the cage floor 25 and has at each side of the support 8 a projection 32 and the support 8 is exchangeable after removal of the connecting element.

Figure 5:
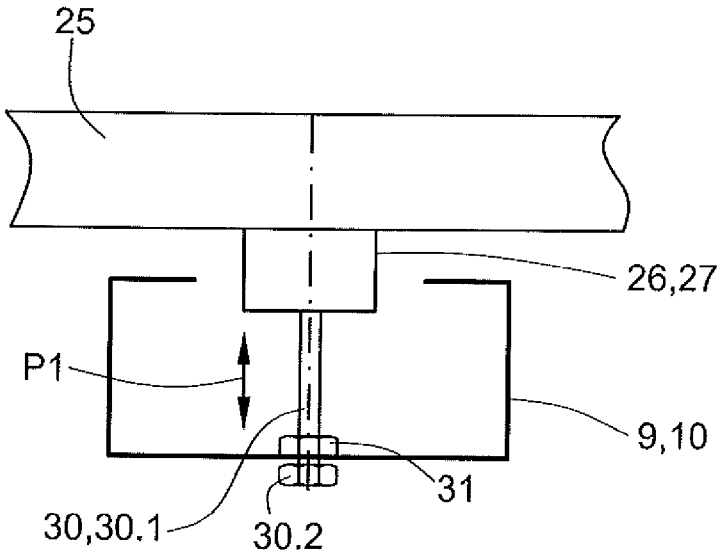
FIG. 5 shows an exemplary embodiment of a lifting device for lifting the elevator cage.

FIG. 5 shows an exemplary embodiment of a lifting device for lifting the elevator cage if the support 8, or at least one of the damping elements 13, has to be replaced. The lifting device is also shown in FIG. 3. A second bolt 30 with a thread 30.1 and, for example, a hexagonal head 30.2 is arranged near each support 8, wherein the bolt 30 is displaceable by means of a locknut 31 in vertical direction relative to the second or third beam 9, 10. The locknut 31 can be supported at the second or third beam 9, 10 and the free end of the second bolt 30 moves the beam 26, 27 upwardly or also downwardly as indicated by the double arrow P1, in which case the elevator cage 7 rises or lowers. In the normal case the bolt 30 is rotated to such an extent downwardly and the free end of the bolt 30 is spaced to such an extent from the beam 26, 27 that even when the elevator cage 7 is spring-deflected, for example in the case of a buffer travel, no contact can occur between the beam 26, 27 and the free end of the bolt 30.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A support frame for an elevator cage comprising:

a base frame extending under a cage floor of the elevator car;

a plurality of supports connected to the cage floor, each of the supports having at least one damping element arranged thereat, the supports being coupled to the base frame for relative movement between the supports and the base frame, each of the damping elements in contact with and resting on the base frame and supporting the elevator cage, the supports and the damping elements being inserted into the base frame;

a lifting device, by which the elevator cage is movable in a vertical direction, provided at the base frame for selective displacement into and out of contact with the elevator cage to raise the elevator cage relative to the base frame thereby moving at least one of the damping elements out of contact with the base frame to permit removal of the at least one damping element and the support associated therewith from the elevator cage; and a pair of beams arranged at the cage floor;

wherein the supports are directly connected with the beams by horizontally oriented bolts, with projections of each of the bolts penetrating recesses of the base frame such that a clearance between the bolts and the recesses provides a travel limitation of the elevator cage with respect to the beams.

2. The support frame according to claim 1 wherein the base frame comprises a pair of beams, which beams rest on a lower yoke of the support frame and on which the damping elements rest.

3. The support frame according to claim 2 wherein the beams comprise respective C-shaped cross-sections in which a U-shaped cross-section of each of the supports is inserted.

4. The support frame according to claim 1 wherein the pair of beams include first and second ends connected to associated ones of the supports.

5. The support frame according to claim 1 wherein the lifting device includes a bolt supported at one end by a beam of the base frame and having a free end adjacent a beam of the cage floor, and a locknut on the bolt for moving the bolt into and out of contact with the elevator cage.

6. An elevator installation comprising:

an elevator cage; and a support frame supporting the elevator cage, the support frame comprising:

a base frame extending under a cage floor of the elevator cage;

a plurality of supports connected to the cage floor, each of the supports having at least one damping element arranged thereat, the supports being coupled to the base frame for relative movement between the supports and the base frame, each of the damping elements in contact with and resting on the base frame and supporting the elevator cage, the supports and the damping elements being inserted into the base frame;

a lifting device, by which the elevator cage is movable in a vertical direction, provided at the base frame for selective displacement into and out of contact with the elevator cage to raise the elevator cage relative to the base frame thereby moving at least one of the damping elements out of contact with the base frame to permit removal of the at least one damping element and the support associated therewith from the support frame; and a pair of beams arranged at the cage floor;

wherein the supports are directly connected with the beams by horizontally oriented bolts, with projections of each of the bolts penetrating recesses of the base frame such that a clearance between the bolts and the recesses provides a travel limitation of the elevator cage with respect to the beams.

* * * * *